US007722204B1

(12) United States Patent
Sandberg

(10) Patent No.: US 7,722,204 B1
(45) Date of Patent: May 25, 2010

(54) COOLER

(76) Inventor: Jayson T. Sandberg, 3400 Cabana Dr. #2098, Las Vegas, NV (US) 89122

( * ) Notice: Subject to any disclaimer, the term of this patent is extended or adjusted under 35 U.S.C. 154(b) by 739 days.

(21) Appl. No.: 11/636,076

(22) Filed: Dec. 8, 2006

(51) Int. Cl.
*F21V 33/00* (2006.01)

(52) U.S. Cl. ..... 362/92; 362/94; 362/155

(58) Field of Classification Search ..... 362/192, 362/92, 94, 155, 204, 101, 154, 276, 802; 62/440, 235.1, 236
See application file for complete search history.

(56) References Cited

U.S. PATENT DOCUMENTS 5,153,561 A * 10/1992 Johnson ..... 340/571
6,305,185 B1 * 10/2001 Sloan ..... 62/457.7
7,188,491 B2 * 3/2007 Donald et al. ..... 62/457.7
2006/0193126 A1 * 8/2006 Kuelbs et al. ..... 362/155
2008/0031483 A1 * 2/2008 Hill ..... 381/334
2009/0049859 A1 * 2/2009 Moon ..... 62/457.7
2009/0158770 A1 * 6/2009 Cohrs et al. ..... 62/457.9

* cited by examiner

*Primary Examiner*—Jacob Y Choi

(57) ABSTRACT

A cooler is disclosed. An illustrative embodiment of the cooler includes a thermally-insulated cooler receptacle having a receptacle interior and a thermally-insulated cooler lid carried by the cooler receptacle and positional between open and closed positions. A pressure switch is carried by the cooler receptacle. The pressure switch is closed when the cooler lid is in the open position and open when the cooler lid is in the closed position. A plurality of LEDs is provided in the receptacle interior and connected to the pressure switch. A power source is connected to the pressure switch.

1 Claim, 6 Drawing Sheets

COOLER

FIELD

The present invention relates to coolers. More particularly, the present invention relates to a cooler having an illuminated interior.

BACKGROUND

Coolers are commonly used to transport food and/or beverages in a cold condition. A typical conventional cooler includes an insulated receptacle having a pivoting or removable insulated lid. Various food items and/or beverages can be contained in the receptacle with ice to keep the items or beverages cold during travel, for example. In a dark environment, however, it can be difficult to discern the contents of the cooler.

SUMMARY

The present invention is generally directed to a cooler. An illustrative embodiment of the cooler includes a thermally-insulated cooler receptacle having a receptacle interior and a thermally-insulated cooler lid carried by the cooler receptacle and positional between open and closed positions. A pressure switch is carried by the cooler receptacle. The pressure switch is closed when the cooler lid is in the open position and open when the cooler lid is in the closed position. A plurality of LEDs is provided in the receptacle interior and connected to the pressure switch. A power source is connected to the pressure switch.

BRIEF DESCRIPTION OF THE DRAWINGS

The invention will now be described, by way of example, with reference to the accompanying drawings, in which.

DETAILED DESCRIPTION

Figure 1:
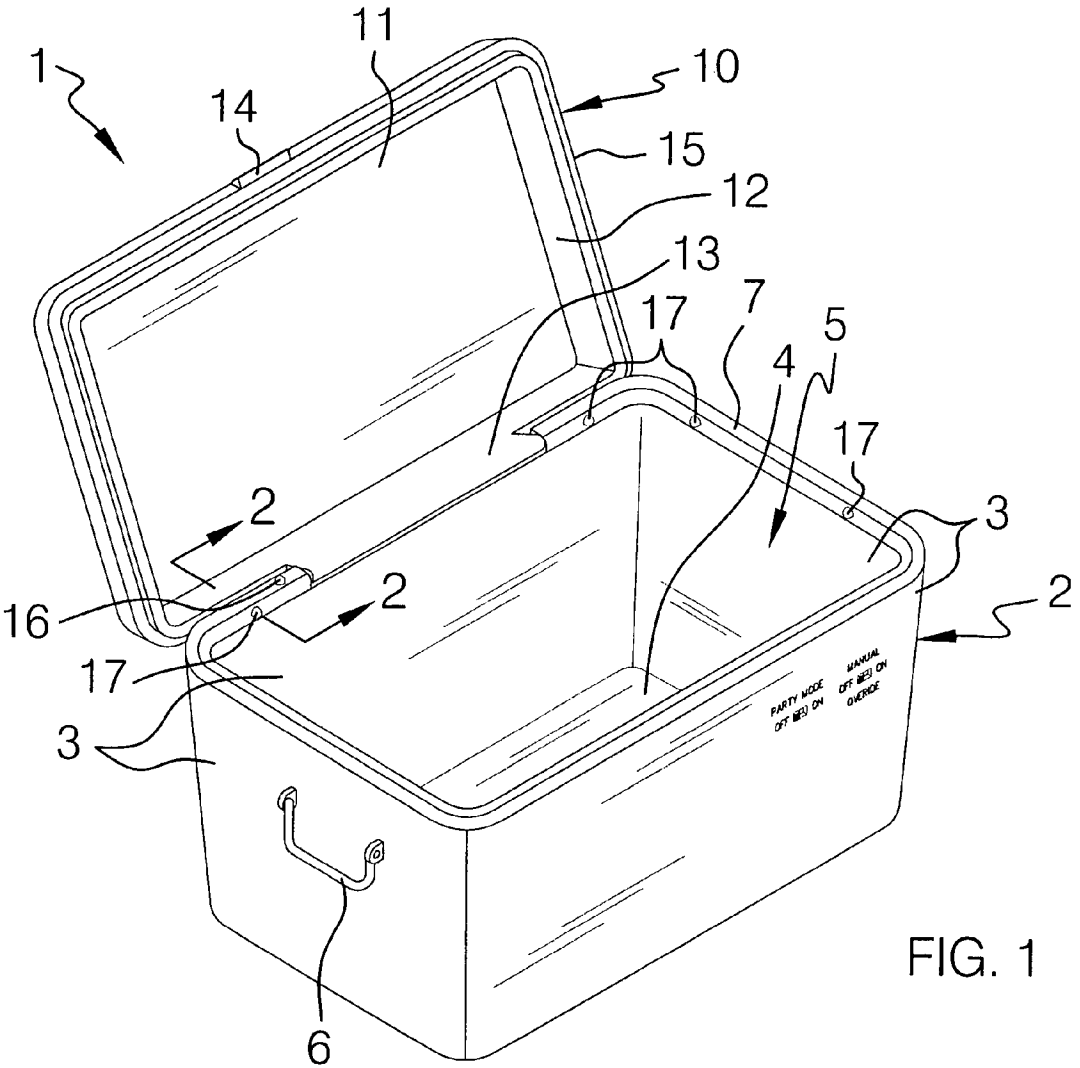
FIG. 1 is a front perspective view of an illustrative embodiment of the cooler, shown in an open configuration.
Figure 2:
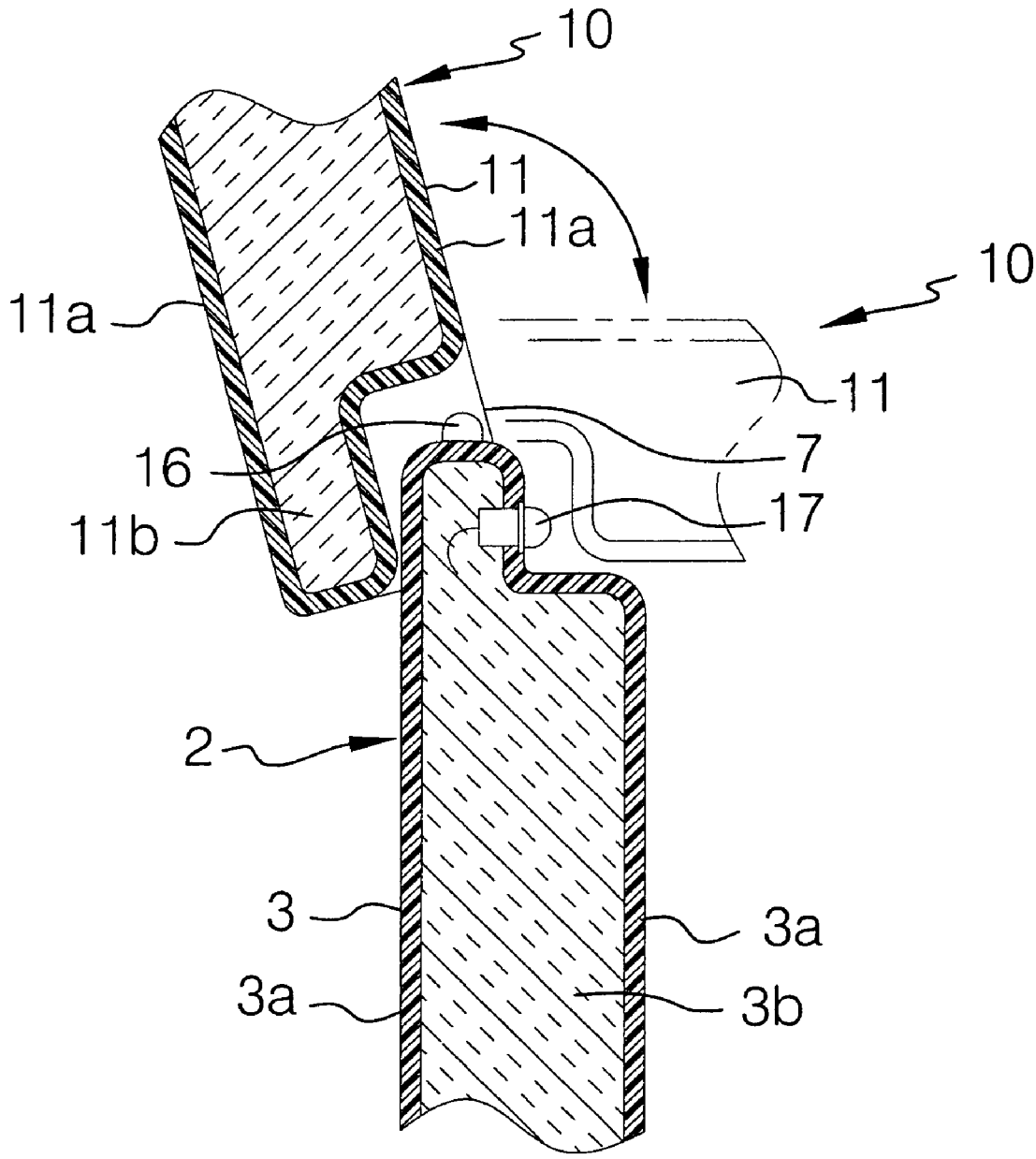
FIG. 2 is a sectional view, taken along section lines 2-2 in FIG. 1, illustrating a typical mechanism for illuminating multiple LEDs (one of which is shown) in the cooler receptacle element of the cooler responsive to opening of a lid on the cooler receptacle.

Referring to the drawings, an illustrative embodiment of the cooler is generally indicated by reference numeral 1. The cooler 1 includes a thermally-insulated cooler receptacle 2 which may have a generally elongated, rectangular shape, as shown, or any suitable alternative shape. As shown in FIG. 1, the cooler receptacle 2 includes receptacle walls 3 which extend from a receptacle bottom 4. The receptacle 2 has a receptacle interior 5 which, in typical use of the cooler 1, is adapted to contain various items such as ice, food and/or beverages (not shown). Receptacle handles 6 may be provided on the receptacle walls 3 at respective ends of the cooler receptacle 2. A receptacle lip 7 may be provided along the edge of the receptacle walls 3. As shown in FIG. 2, each receptacle wall 3 of the cooler receptacle 2 typically includes a wall shell 3*a* and thermal insulation 3*b* provided in the wall shell 3*a*.

A thermally-insulated cooler lid 10 is provided on the cooler receptacle 2. The cooler lid 10 typically includes a lid panel 11. As shown in FIG. 2, the lid panel 11 of the cooler lid 10 typically includes a panel shell 11*a* and thermal insulation 11*b* provided in the panel shell 11*a*. As shown in FIG. 1, lid sides 12 extend from the lid panel 11. A hinge 13 typically connects a portion of the lid sides 12 to a receptacle wall 3 of the cooler receptacle 2. A latch 14 is typically provided on the cooler lid 10 to detachably engage the cooler receptacle 2. A lid lip 15 typically extends from the lid sides 12 and mates with the receptacle lip 7 of the cooler receptacle 2 when the cooler lid 10 is closed on the cooler receptacle 2.

Figure 5:
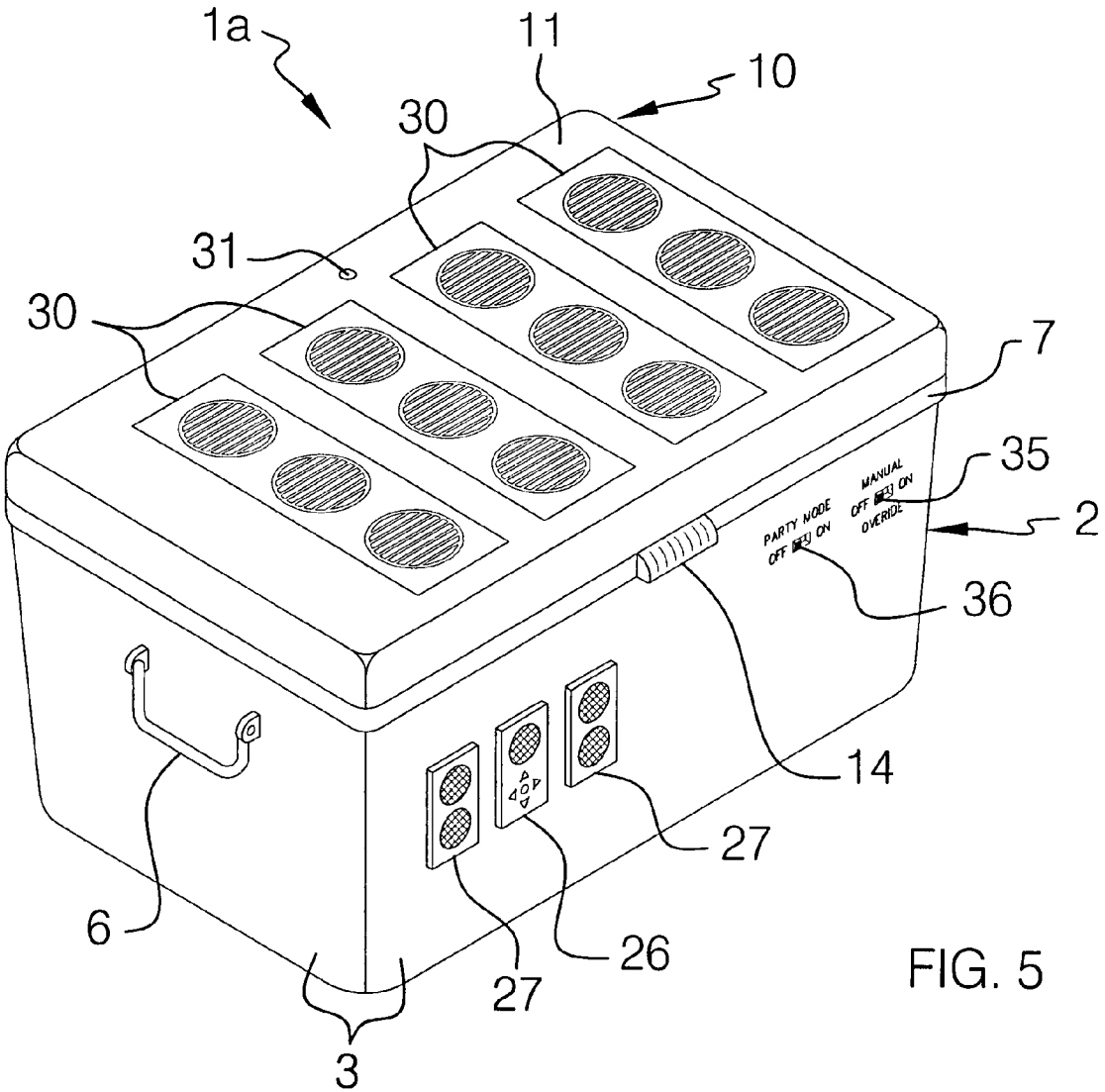
FIG. 5 is a front perspective view of an alternative illustrative embodiment of the cooler, with multiple solar panels provided in a lid element of the cooler.
Figure 6:
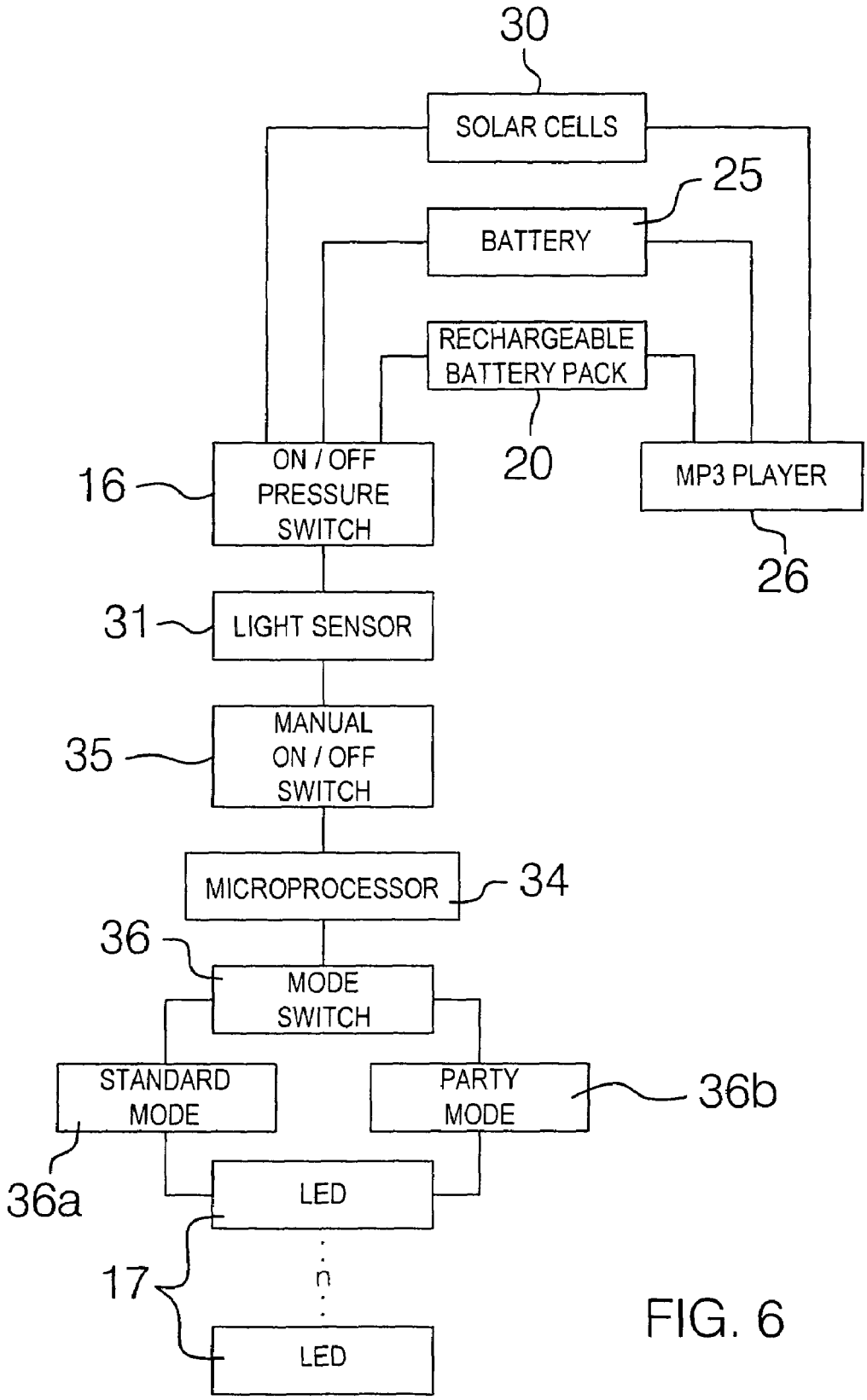
FIG. 6 is a block diagram illustrating interconnection of various components of an illustrative embodiment of the cooler.

As shown in FIG. 6, a microprocessor 34 is provided typically in one of the receptacle walls 3 of the cooler receptacle 2. A manual power switch 35, the purpose of which will be hereinafter described, is connected to the microprocessor 34. A mode switch 36 is connected to the microprocessor 34. As shown in FIG. 5, the manual power switch 35 and the mode switch 36 may be provided, for example, on the exterior surface of one of the receptacle walls 3 of the cooler receptacle 2.

In some embodiments of the cooler 1, a light sensor 31 is connected to the microprocessor 34. As shown in FIG. 5, the light sensor 31 may be provided, for example, on the cooler lid 10. A pressure switch 16 is connected to the microprocessor and is typically provided on the receptacle lip 7 of the cooler receptacle 2, as shown in FIG. 2. Accordingly, when it is pivoted to the open position or detached from the cooler receptacle 2, as indicated by the solid lines in FIG. 2, the cooler lid 10 releases and closes the pressure switch 16. Conversely, when it is pivoted to the closed position on the cooler receptacle 2, as indicated by the phantom lines in FIG. 2, the cooler lid 10 depresses and opens the pressure switch 16.

Figure 4:
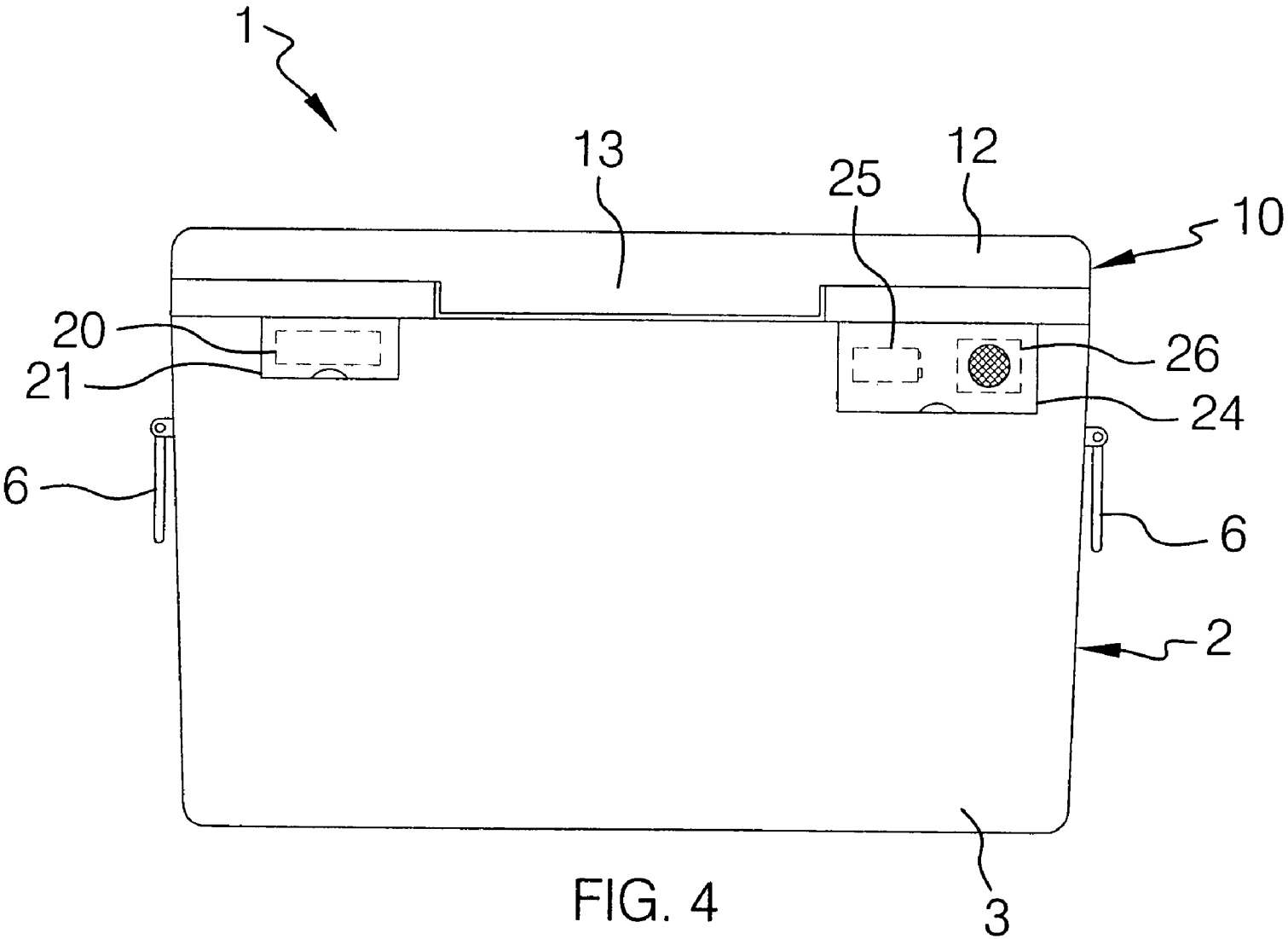
FIG. 4 is a rear view of an illustrative embodiment of the cooler.

As further shown in FIG. 6, a rechargeable battery pack 20, a disposable battery 25 and/or solar cells 30 is/are typically connected to the microprocessor 34. A recordable medium player, such as an MP3 player 26, for example, is connected to the microprocessor 34 and the rechargeable battery pack 20, the disposable battery 25 and/or the solar cells 30. As shown in FIG. 4, in some embodiments of the cooler 1, the disposable battery 25 and MP3 player 26 are located behind a detachable access panel 24 which is provided on one of the receptacle walls 3 of the cooler receptacle 2. In alternative embodiments of the cooler 1*a*, shown in FIG. 5, the MP3 player 26 is provided on one of the receptacle walls 3 of the cooler receptacle 2. At least one speaker 27 is provided on the receptacle wall 3, typically adjacent to the MP3 player 26. As further shown in FIG. 4, in some embodiments of the cooler 1, the rechargeable battery pack 20 is located behind a detachable access panel 21 which is provided on one of the receptacle walls 3. As further shown in FIG. 5, the solar cells 30 are typically provided in the lid panel 11 of the cooler lid 10.

Figure 3:
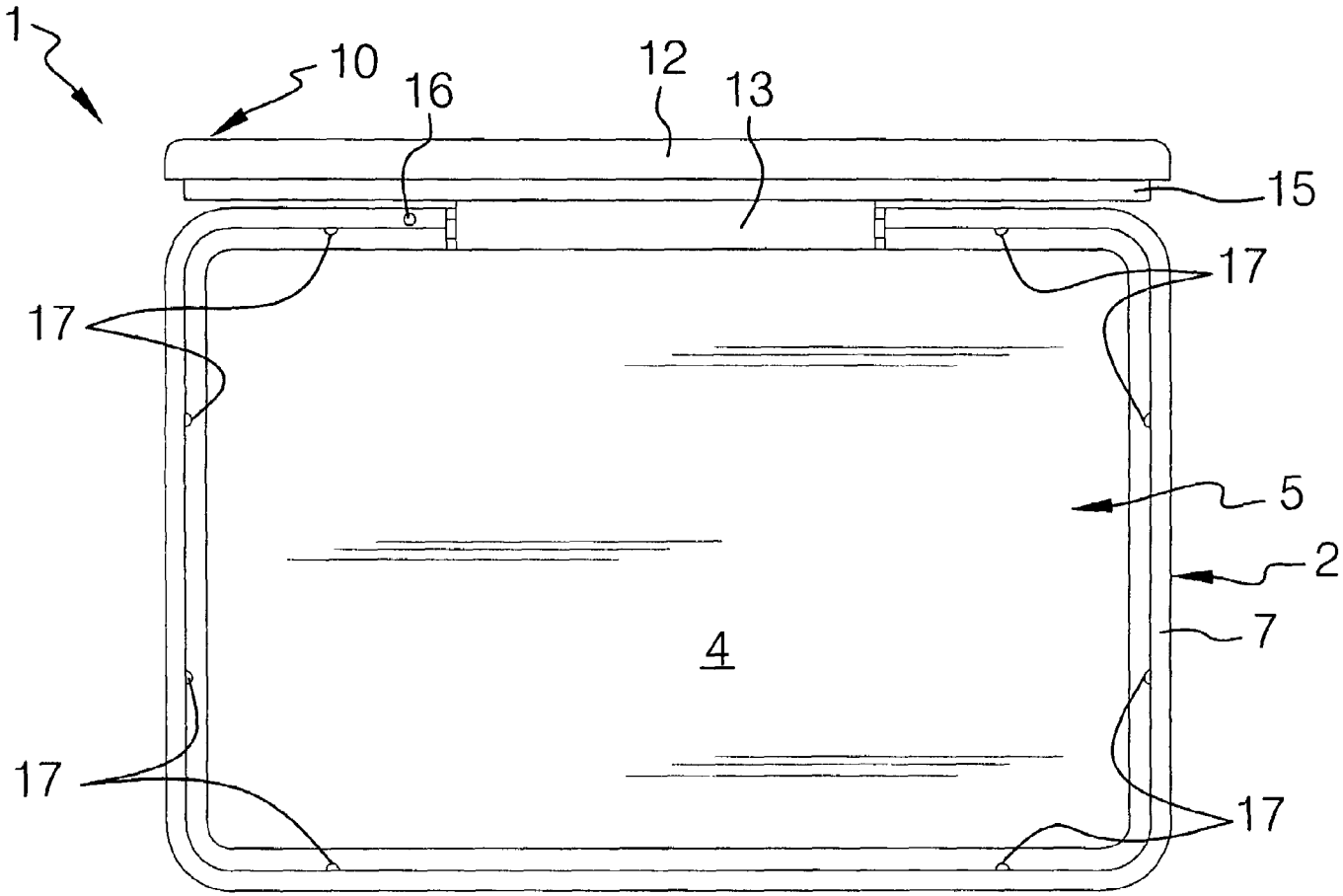
FIG. 3 is a top view of an illustrative embodiment of the cooler, shown in an open configuration.

As further shown in FIG. 6, multiple LEDs 17 are connected to the microprocessor 34 such as through the mode switch 36. As shown in FIGS. 1-3, the LEDs 17 are provided in the receptacle interior 5 of the cooler receptacle 2, such as on the interior surfaces of the receptacle walls 3, for example, in spaced-apart relationship with respect to each other adjacent to the receptacle lip 7.

The microprocessor 34 is adapted to operate the LEDs 17 in a standard mode 36*a* or both the LEDs 17 and the MP3 player in a "party" mode 36*b*. Accordingly, upon positioning of the manual power switch 35 in the "on" position, electrical power from the rechargeable battery pack 20, the battery 25 and/or the solar cells 30 is supplied to the microprocessor 34. When the standard mode 36*a* is selected using the mode switch 36, the pressure switch 16 is open, and therefore, the microprocessor 34 maintains the LEDs 17 in an "off" status when the cooler lid 10 is closed on the cooler receptacle 2. The pressure switch 16 is closed, and therefore, the microprocessor 34 illuminates the LEDs 17 upon opening of the cooler lid 10 on the cooler receptacle 2. Therefore, the LEDs 17 illuminate the receptacle interior 5 of the cooler receptacle 2 to render visible the contents of the receptacle interior 5. In some embodiments of the cooler 1, the light sensor 31 is connected to the microprocessor 34, which maintains the pressure switch 16 in the open position when the cooler lid 10 is opened on the cooler receptacle 2 in the event that ambient light around the cooler 1 equals or exceeds a predetermined threshold brightness and is therefore sufficient to illuminate the receptacle interior 5 of the cooler receptacle 2 without illumination of the LEDs 17.

When the "party" mode 36*b* is selected using the mode switch 30, upon subsequent opening of the cooler lid 10 on the cooler receptacle 2, the microprocessor 34 facilitates illumination of the LEDs 17 through the closed pressure switch 16, as was heretofore described with respect to the standard mode 36*a*. Additionally, the microprocessor 34 operates the MP3 player 26 through the closed pressure switch 31. Accordingly, the MP3 player can be pre-loaded with selected music. Upon subsequent opening of the cooler lid 10 on the cooler receptacle 2, the MP3 player plays the music as the LEDs 17 simultaneously illuminate the receptacle interior 5 of the cooler receptacle 2. Upon closing of the cooler lid 10 on the cooler receptacle 2, the pressure switch 16 is again opened, thereby turning off both the LEDs 17 and the MP3 player 26. In some embodiments of the cooler 1, the battery pack 20 (FIG. 4) can be replaced by removing the access panel 21, whereas the disposable battery 25 (FIG. 4) can be replaced and/or the MP3 player 26 accessed by removing the access panel 24. In other embodiments of the cooler 1*a*, shown in FIG. 5, the MP3 player 26 can be accessed on the receptacle wall 3 of the cooler receptacle 2.

While the preferred embodiments of the invention have been described above, it will be recognized and understood that various modifications can be made in the invention and the appended claims are intended to cover all such modifications which may fall within the spirit and scope of the invention.

What is claimed is:

1. A cooler, comprising:

a thermally-insulated cooler receptacle having a plurality of receptacle walls defining a receptacle interior;

a thermally-insulated cooler lid carried by said cooler receptacle and positional between open and closed positions;

a microprocessor carried by one of said cooler receptacle and said cooler lid;

a pressure switch carried by one of said cooler receptacle and said cooler lid and connected to said microprocessor, said pressure switch closed when said cooler lid is in said open position and said pressure switch open when said cooler lid is in said closed position;

a plurality of LEDs carried by said plurality of receptacle walls in said receptacle interior and connected to said microprocessor;

an MP3 player carried by said cooler receptacle and connected to said microprocessor;

a mode switch connected to said microprocessor, said microprocessor operates said plurality of LEDs in a first mode and said plurality of LEDs and said MP3 player in a second mode responsive to pivoting said cooler lid from said closed position to said open position on said cooler receptacle; and a power source connected to said microprocessor.

* * * * *